US010889462B2

(12) United States Patent
Chai

(10) Patent No.: US 10,889,462 B2
(45) Date of Patent: Jan. 12, 2021

(54) CABLE REEL FOR EXCAVATOR

(71) Applicant: Qingling Chai, Hebei (CN)

(72) Inventor: Qingling Chai, Hebei (CN)

( * ) Notice: Subject to any disclaimer, the term of this patent is extended or adjusted under 35 U.S.C. 154(b) by 108 days.

(21) Appl. No.: 16/252,693

(22) Filed: Jan. 20, 2019

(65) Prior Publication Data

US 2019/0315590 A1 Oct. 17, 2019

Related U.S. Application Data

(63) Continuation of application No. PCT/CN2018/079759, filed on Mar. 21, 2018.

(51) Int. Cl.
*B65H 75/42* (2006.01)
*B65H 75/44* (2006.01)

(52) U.S. Cl.
CPC ..... *B65H 75/4457* (2013.01); *B65H 75/42* (2013.01); *B65H 75/4405* (2013.01); *B65H 75/4442* (2013.01); *B65H 75/4486* (2013.01); *B65H 2701/34* (2013.01)

(58) Field of Classification Search
CPC .. B65H 2701/34; B65H 75/42; B65H 75/425; B65H 75/4405; B65H 75/4407; B65H 75/4442; B65H 75/4457; B65H 75/4486; H02G 11/02
USPC ..... 191/12 C
See application file for complete search history.

(56) References Cited

U.S. PATENT DOCUMENTS 1,999,261 A * 4/1935 Shultz ..... E21C 35/223 209/142
4,164,331 A * 8/1979 Henrich ..... B65H 51/16 242/157 R
4,542,861 A * 9/1985 Barnes ..... B60P 3/035 242/393
5,161,857 A * 11/1992 Mayercheck ..... E21C 35/24 299/1.4
RE34,488 E * 12/1993 Clark ..... B65H 54/2896 242/386
5,330,122 A * 7/1994 Wood ..... B65H 54/2821 242/397.3

* cited by examiner

*Primary Examiner* — Mark T Le

(57) ABSTRACT

A cable reel includes an outer frame and a reel assembly. The reel assembly is installed on the outer frame. The reel assembly includes a left reel and a right reel. An inner bracket is arranged in the outer frame. The inner bracket includes a left bracket and a right bracket which are respectively connected with the left reel and the right reel. A telescopic cylinder for controlling the swing is arranged between the left bracket and the right bracket.

2 Claims, 3 Drawing Sheets

CABLE REEL FOR EXCAVATOR

CROSS-REFERENCE TO RELATED APPLICATIONS

This application is a continuation of International Patent Application No. PCT/CN2018/079759, filed on Mar. 21, 2018, which claims the benefit of priority from Chinese Application No. 201810199473.7, filed on Mar. 7, 2018. The entire contents of the aforementioned applications, including any intervening amendments thereto, are incorporated herein by reference.

TECHNICAL FIELD

The present invention belongs to the field of excavator equipment, and particularly relates to a cable reel for an excavator.

BACKGROUND

A cable reel is a cable winder that provides a power source, a control power source or a control signal for large mobile equipment. It is widely used in harbor portal cranes, container cranes, ship loaders, tower cranes and other heavy mechanical equipment of similar working conditions. The cable reel is mainly applied in an excavator which is a machine used to excavate straight underground tunnels. The excavator is classified into open excavators and shield excavators, and is mainly composed of a traveling mechanism, an operating mechanism, a shipping mechanism and a transferring mechanism. As the traveling mechanism advances, a cutting head in the operating mechanism continuously breaks the rock and carries away the broken rock. The excavator has the advantages of safety, high efficiency and good tunnel forming quality, but has large construction cost, complicated structure and large loss.

At present, China has become the world's largest excavator manufacturing base and application market. With the rapid growth of domestic urban road traffic, railways, highways, water conservancy, municipal engineering and other construction projects, China's excavating machines are also rapidly developed. China's excavating machine industry has become a development industry supported by the domestic high-end equipment manufacturing industry and strategic emerging industry.

Moreover, due to the large power required by the excavator, most existing excavators use oil-fired power mechanisms, causing great consumption of energy and serious environmental pollution. At present, electric excavators have been used in China. The electric excavators need long cables to ensure their operating ranges. A lot of manpower is required for movement of long-distance cables, which is very inconvenient and low in operating efficiency. It is easy to damage the cables and bring danger to the working environment if the cables are dragged on the ground. The existing cable reel for the excavator has a limited retractable volume and single application. Therefore, it has become an urgent problem to provide a cable reel that can prevent the cables from being damaged, facilitate cable movement and wind and unwind different cables.

SUMMARY

To solve the above technical problems, the present invention provides a cable reel for an excavator that can prevent the cables from being worn, facilitate cable movement, realize high working efficiency and wind and unwind different cables.

To achieve the above purpose, the technical solution adopted by the present invention is: a cable reel for an excavator comprises an outer frame and a reel assembly, wherein the reel assembly is installed on a lower part of the excavator through the outer frame, characterized in that: the outer frame is provided with a speed reducer and a wiring device assembly; the speed reducer is connected with the reel assembly; the reel assembly is connected with the wiring device assembly; the wiring device assembly comprises a wiring device speed reducer and a wiring device assembly; the output end of the wiring device speed reducer is provided with a driving sprocket; the driving sprocket is connected with the reel assembly through a first chain; the first chain is provided with a fork and drives the wiring device assembly through the fork to realize reciprocating motion; the reel assembly comprises a left reel and a right reel; an inner bracket is arranged in the outer frame; the inner bracket comprises a left bracket and a right bracket which are respectively connected with the left reel and the right reel; and a telescopic cylinder for controlling the left bracket and the right bracket to swing is arranged between the left bracket and the right bracket.

As a further improvement of the present invention, the cross section of the left reel is a semicircular cambered surface; a tripod is fixed to the inner wall of the left reel; and the tripod comprises a supporting rack and a cross beam.

As a further improvement of the present invention, the cross section of the right reel is provided with an open circular cambered surface; and the outer wall of the right reel is matched with the inner wall of the left reel.

As a further improvement of the present invention, the left reel and the left bracket are connected through an outer shaft provided with a cylindrical groove; a cylindrical shaft is matched in the cylindrical groove; and the cylindrical shaft is used for connecting the right reel and the right bracket.

As a further improvement of the present invention, the reel assembly is connected with a seal box body; and the seal box body is provided with a current collector inside and transmits cable current to the excavator through the current collector.

As a further improvement of the present invention, a motor is installed on the speed reducer; and the motor is linearly connected with the telescopic cylinder and controls expansion and contraction of the telescopic cylinder.

As a further improvement of the present invention, the speed reducer is respectively connected with the cylindrical shaft and the outer shaft through a small chain and a large chain.

Compared with the prior art, the present invention has the beneficial effects that: the present invention is reasonable in design and simple in structure, can effectively prevent cables from being worn and can facilitate movement of the cables, thereby prolonging the service life of the cables and increasing working efficiency of the excavator. The present invention not only can roll the same kind of cables, but also can roll different kinds of cables, so the application range is large.

In the figures: 1—outer frame; 2—reel assembly; 3—speed reducer; 4—wiring device assembly; 5—wiring device speed reducer; 6—wiring device assembly; 7—fork; 8—left reel; 9—right reel; 10—left bracket; 11—right bracket; 12—motor; 13—bottoming alarm component; 14—reel protection cover; 15—seal box body; 16—alarm lamp; 17—chain breaking alarm device; 18—blocking wheel; 19—telescopic cylinder; 20—supporting rack; 21—cross beam; 22—outer shaft; and 23—cylindrical shaft.

DETAILED DESCRIPTION

The present invention is further explained below in combination with drawings and specific embodiments, but the protection scope of the present invention is not limited.

Figure 1:
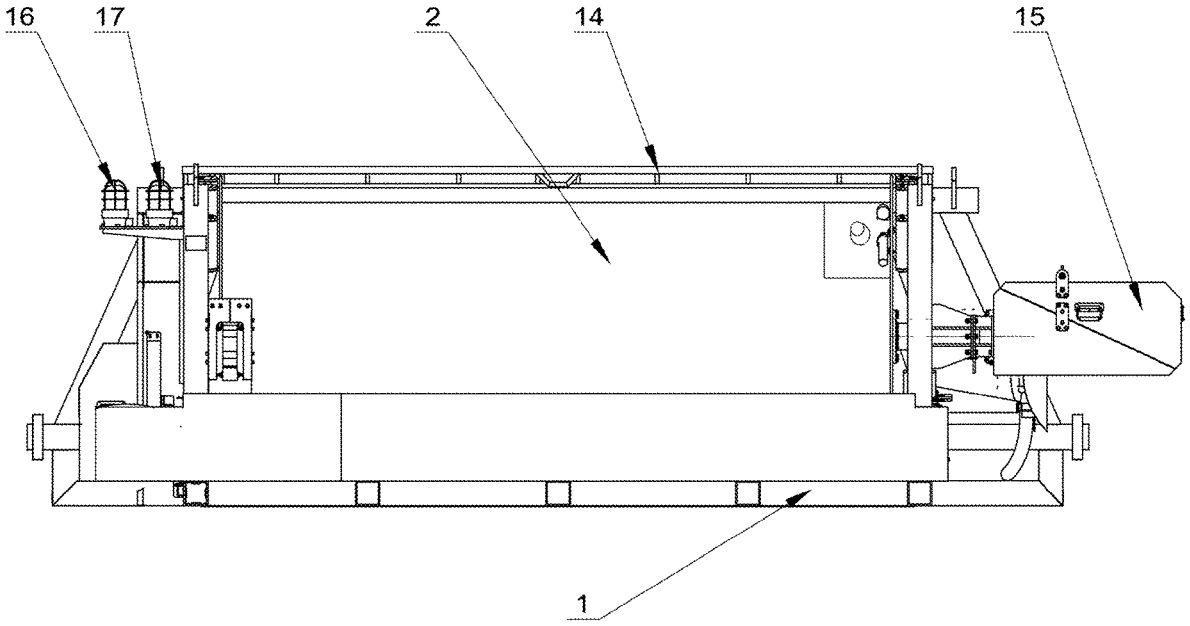
FIG. 1 is a main structural schematic diagram of the present invention.
Figure 2:
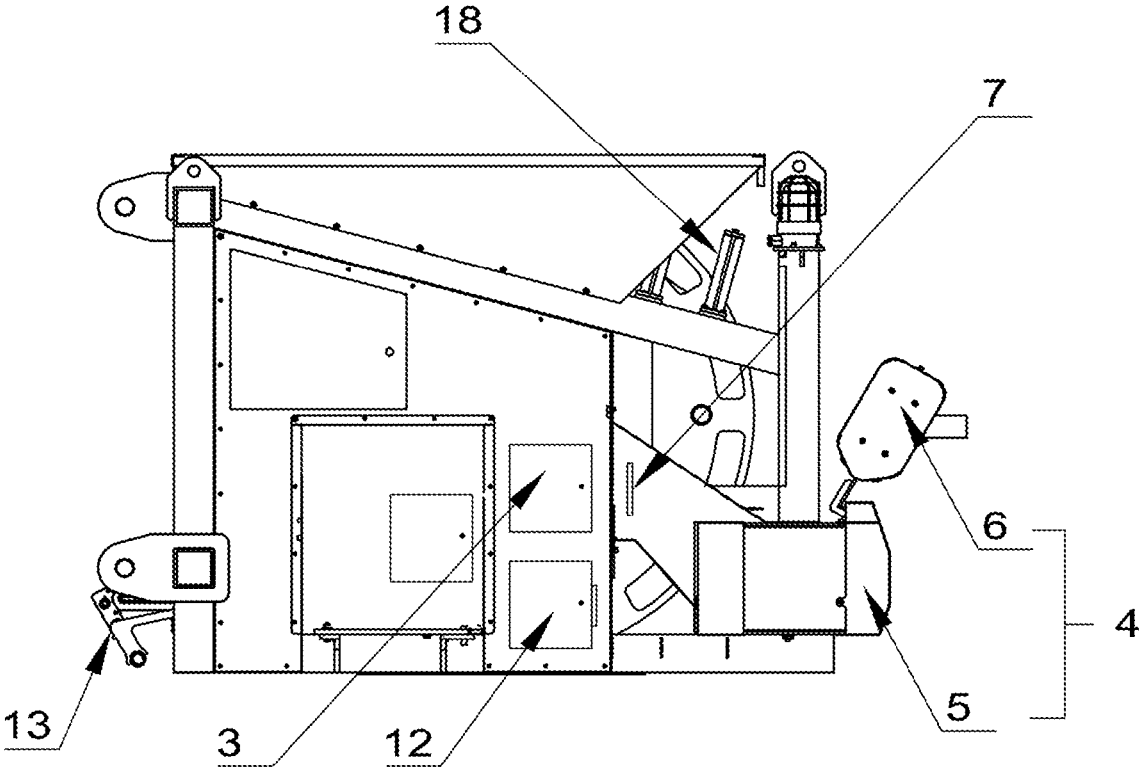
FIG. 2 is a left structural schematic diagram of the present invention.
Figure 3:
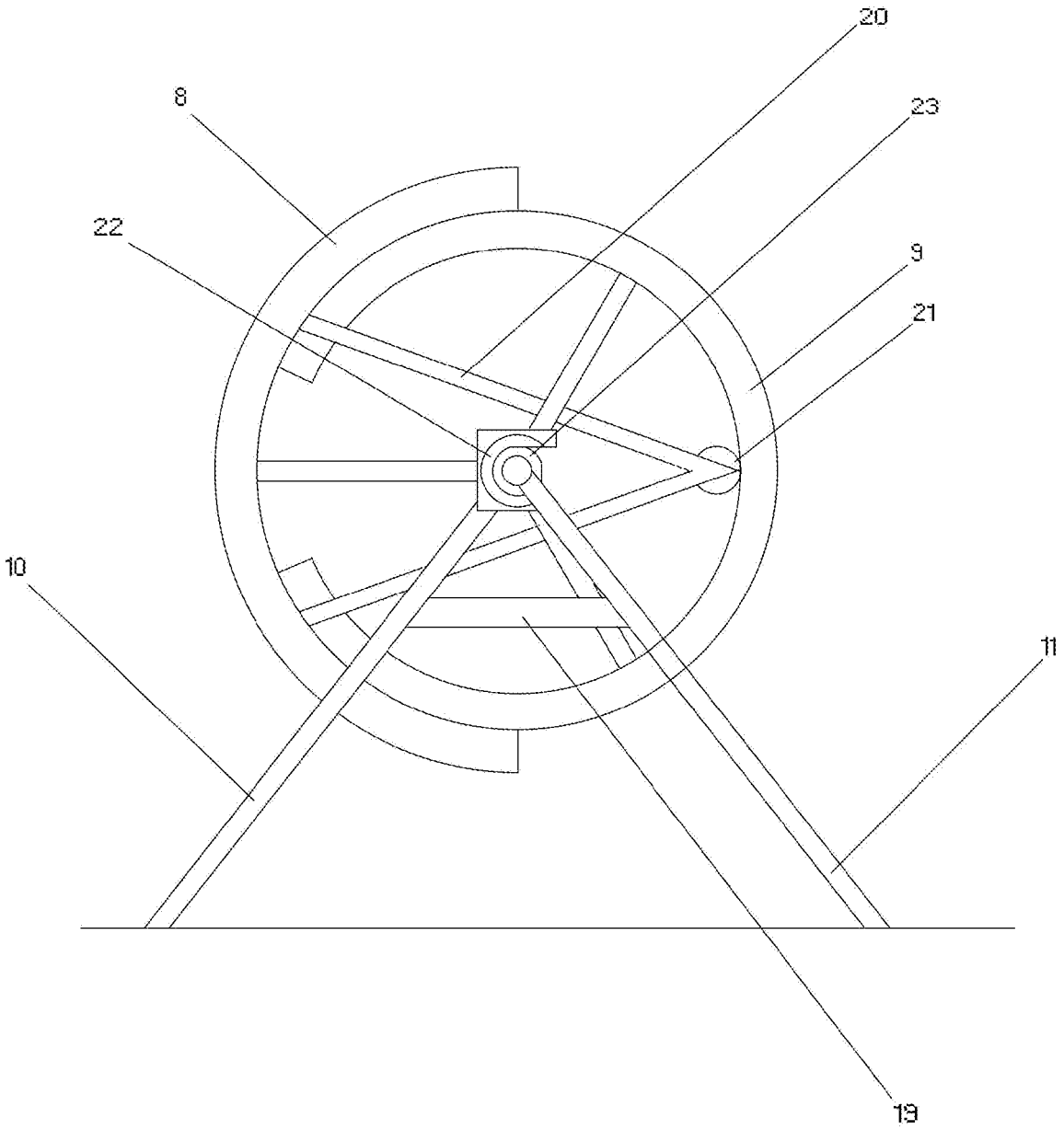
FIG. 3 is a structural schematic diagram of a cable reel of the present invention.

As shown in FIG. 1 to FIG. 3, a cable reel for an excavator comprises an outer frame 1 and a reel assembly 2, wherein the reel assembly 2 is installed on a lower part of the excavator through the outer frame 1. The outer frame 1 is provided with a speed reducer 3 and a wiring device assembly 4. The speed reducer 3 is connected with the reel assembly 2; the reel assembly 2 is connected with the wiring device assembly 4; the wiring device assembly 4 comprises a wiring device speed reducer 5 and a wiring device assembly 6; the output end of the wiring device speed reducer 5 is provided with a driving sprocket; the driving sprocket is connected with the reel assembly 2 through a first chain; the first chain is provided with a fork 7 and drives the wiring device assembly 6 through the fork to realize reciprocating motion; and the transmission ratio of the sprocket can be changed to change a wiring thread pitch. The reel assembly 2 comprises a left reel 8 and a right reel 9; an inner bracket is arranged in the outer frame 1; the inner bracket comprises a left bracket 10 and a right bracket 11 which are respectively connected with the left reel 8 and the right reel 9; and a telescopic cylinder 19 for controlling the left bracket 10 and the right bracket 11 to swing is arranged between the left bracket 10 and the right bracket 11. The cross section of the left reel 8 is a semicircular cambered surface; a tripod is fixed to the inner wall of the left reel 8; and the tripod comprises a supporting rack 20 and a cross beam 21. The cross section of the right reel 9 is provided with an open circular cambered surface; and the outer wall of the right reel 9 is matched with the inner wall of the left reel 8. The left reel 8 and the left bracket 10 are connected through an outer shaft 22 provided with a cylindrical groove; a cylindrical shaft 23 is matched in the cylindrical groove; and the cylindrical shaft 23 is used for connecting the right reel 9 and the right bracket 11. The reel assembly 2 is connected with a seal box body 15; and the seal box body 15 is provided with a current collector inside and transmits cable current to the excavator through the current collector. A motor 12 is installed on the speed reducer 3; and the motor 12 is linearly connected with the telescopic cylinder 19 and controls expansion and contraction of the telescopic cylinder 19. The speed reducer 3 is respectively connected with the cylindrical shaft 23 and the outer shaft 22 through a small chain and a large chain.

The reel assembly 2 is connected with a seal box body 15; and the seal box body 15 is provided with a current collector inside and transmits cable current to the excavator through the current collector.

The current collector is composed of a brush holder, an electric brush, a pressure spring, a high-voltage insulator, a collector ring, etc. The collector ring is composed of five copper rings which are fixed using the high-voltage insulator. Both ends of the collector ring are supported by bearings. The axis of a main shaft of the collector ring is concentric with the axis of the reel. The collector ring is fluctuated and rotated by the reel. Wires rolled by the reel penetrate through the main shaft and are received on the rings; and wires which enter the excavator are received on the brush holder. The tail of the brush holder is fixed to the outer frame 1. The outer frame 1 is fixed to the box body. The electric brush is installed on the brush holder. The pressure spring is fixed to the brush holder. At the same time, pressure is applied to the electric brush so that the electric brush and the rings come into close contact to ensure normal conduction. The motor 12 is installed on the speed reducer 3. The outer frame 1 is provided with the bottoming alarm component 13, and the bottoming alarm component 13 is linearly connected with the reel assembly 2. The bottoming alarm component comprises an alarm lamp 16 which can display red light and yellow light; the alarm lamp is connected with a chain breaking alarm device 17; and the chain breaking alarm device 17 is arranged below the first chain and a second chain. When the chain is broken, the alarm lamp 16 displays the red light; and when the chain is bottomed, the alarm lamp 16 displays the yellow light. The bracket is provided with a reel protection cover 14, and the reel protection cover 14 is arranged above the reel assembly 2. The wiring device component 6 is provided with a cable inlet. A blocking wheel 18 which can prevent the cables from falling into a gap between the reel assembly 2 and the outer frame 1 is arranged in the position of the reel assembly 2 on the outer frame 1.

The present invention can control the operation of the motor 12 to control expansion and contraction of the telescopic cylinder 19, so that the left reel 8 and the right reel 9 are opened and closed. When opened, the left reel 8 and the right reel 9 are operated individually and wind different cables respectively. When closed, the left reel 8 and the right reel 9 form a whole, thereby extending the range of application.

For those skilled in the art, apparently, the present invention is not limited to details of the above demonstrative embodiments. Moreover, the present invention can be realized in other specific forms without departing from the spirit or basic feature of the present invention. Therefore, in all respects, the embodiments shall be regarded to be demonstrative and nonrestrictive. The scope of the present invention is defined by appended claims, rather than the above description. Therefore, the present invention is intended to include all changes falling into the meaning and the scope of equivalent elements of claims within the present invention. Any drawing mark in claims shall not be regarded to limit the concerned claims.

In addition, it shall be understood that although the description is explained in accordance with the embodiments, not every embodiment only includes one independent technical solution. This narration mode of the description is only for clarity. Those skilled in the art shall regard the description as a whole, and the technical solution in each embodiment can also be appropriately combined to form other embodiments understandable for those skilled in the art.

What is claimed is:

1. A cable reel for an electric excavator, comprising:

an outer frame and a reel assembly installed on the outer frame;

wherein the reel assembly is connected with a wiring device assembly; the wiring device assembly comprises a speed reducer;

the reel assembly comprises a left reel and a right reel; an inner bracket is arranged in the outer frame; the inner bracket comprises a left bracket and a right bracket which are respectively connected with the left reel and the right reel; and a telescopic cylinder for controlling the left bracket and the right bracket to swing is arranged between the left bracket and the right bracket;

a cross section of the left reel is a semicircular cambered surface; a tripod is fixed to an inner wall of the left reel; the tripod comprises a supporting rack and a cross beam; a cross section of the right reel is provided with an open circular cambered surface; and the outer wall of the right reel is matched with the inner wall of the left reel; and a motor is installed on the speed reducer; and the motor is linearly connected with the telescopic cylinder and controls an expansion and contraction of the telescopic cylinder.

2. The cable reel of claim 1, wherein the left reel and the left bracket are connected through an outer shaft provided with a cylindrical groove; a cylindrical shaft matched with the cylindrical groove is configured to connect the right reel and the right bracket.

* * * * *